US005639170A

United States Patent [19]

Miura et al.

[11] Patent Number: 5,639,170

[45] Date of Patent: Jun. 17, 1997

[54] PRINTING HEAD FOR WIRE-DOT PRINTER

[75] Inventors: Shigeo Miura; Yuji Oshime, both of Kawasaki, Japan

[73] Assignee: Fujitsu Limited, Kawasaki, Japan

[21] Appl. No.: 453,516

[22] Filed: May 30, 1995

Related U.S. Application Data

[63] Continuation of Ser. No. 79,800, Jun. 23, 1993, abandoned.

[30] Foreign Application Priority Data

Jun. 23, 1992 [JP] Japan ..... 4-164468
Jun. 23, 1992 [JP] Japan ..... 4-164469

[51] Int. Cl.[6] ..... B41J 29/08

[52] U.S. Cl. ..... 400/690; 400/124.01; 400/690.4

[58] Field of Search ..... 400/124.01, 124.03, 400/123.13, 689, 690, 690.4

[56] References Cited

U.S. PATENT DOCUMENTS 5,013,169 5/1991 Ikehata et al. ..... 400/124

FOREIGN PATENT DOCUMENTS 0343994 11/1989 European Pat. Off. .
0178078 9/1985 Japan ..... 400/689
0256160 5/1987 Japan ..... 400/689
63-281858 11/1988 Japan .
1-190461 7/1989 Japan .
1-267049 10/1989 Japan .
4-070356 3/1992 Japan .
4-201374 7/1992 Japan .
4-214364 8/1992 Japan .
4-241959 8/1992 Japan .

OTHER PUBLICATIONS

*Patent Abstracts of Japan*, vol. 15, No. 124 (M-1097), 1991 (JP-3-013-348).

*Primary Examiner*—Ren Yan
*Attorney, Agent, or Firm*—Staas & Halsey

[57] ABSTRACT

A wire-dot printing head has a housing in which a plurality of actuator assemblies are accommodated to drive a plurality of wire elements. An annular hollow space is formed in a side wall of the housing surrounding the actuator assemblies, whereby noise and vibration produced during operation of the actuator assemblies can be effectively damped due to the formation of the annular hollow space. When an interior of the housing is partially charged with gel-like damping material for damping the noise and vibration, a hollow space is formed in the charged damping material, whereby the increase in the inertial mass of the printing head can be reduced.

22 Claims, 7 Drawing Sheets

PRINTING HEAD FOR WIRE-DOT PRINTER

This application is a continuation, of application Ser. No. 08/079,800, filed Jun. 23,1993, now abandoned.

BACKGROUND OF THE INVENTION

1) Field of the Invention

The present invention relates to a printing head incorporated in a wire-dot printer, and more particularly, to improvements of such a wire-dot printing head.

2) Description of the Related Art

As is well known, a wire-dot printer represents an impact printer, and such printers are in wide spread use as office-type printers because the running costs thereof are relatively low. Nevertheless, the wire-dot printer is inherently noisy, and produces considerable vibration during the operation thereof, and this constitutes a factor in hindering the spread of the wire-dot printer as a personal-use type.

Japanese Unexamined Patent Publication (KOKAI) No. 4(1992)-70356 discloses a wire-dot printing head, the interior of which is partially charged with gel-like silicone resin for damping the noise and vibration produced during the operation thereof. The gel-like silicone resin is obtained from silicone oil, by hydrosilylation reaction, and has a crosslink density ⅕ to 1/10 less than that of silicone elastomer. The gel-like silicone resin can exhibit a desired viscoelastic property (elastic coefficient, dissipation factor) to effectively damp the noise and vibration produced by the operation of the printing head. Nevertheless, the inertial mass of the printing head is increased due to the charging of the gel-like silicone resin, to thereby cause an amplification of lateral shaking of a wire-dot printer in which this type of printing head is incorporated, and this lateral shaking of the printer produces another noise. Further, the increase in the inertial mass of the printing head impedes the high-speed printing operation of the printer, because it is difficult to quickly accelerate and decelerate the printing head since having an increased inertial mass.

SUMMARY OF THE INVENTION

Accordingly, an object of the present invention is to provide a wire-dot printing head constituted such that the noise and vibration produced by the operation thereof can be effectively damped without charging the interior of the printing head with any noise/vibration damping material.

Another object of the present invention is to provide a wire-dot printing head, an interior of which is charged with noise/vibration damping material, but wherein the increase in the inertial mass of the printing head can be minimized as much as possible.

In accordance with a first aspect of the present invention, there is provided a wire-dot printing head comprising a housing and an actuator accommodated in the housing means for driving a plurality of wire elements, wherein the housing includes a wall surrounding the actuator, and the wall has a hollow space formed therein for damping noise and vibration produced during the operation of the actuator. Preferably, the hollow space is extended as an annular hollow space along the inside of the wall. Further preferably, the annular hollow space is charged with suitable sound-absorbent material for damping noise and vibration produced by the actuator. The sound-absorbent material may be composed of either a foam rubber such as polyurethane foam rubber or a gel-like resin such as gel-like silicone resin. Also, the actuator means may comprise either a piezoelectric type or an electromagnetic type.

In accordance with a second aspect of the present invention, there is provided a wire-dot printing head comprising a housing and an actuator accommodated in the housing for driving a plurality of wire elements, wherein the interior of the housing is partially charged with a gel-like damping material for damping noise and vibration produced during the operation of the actuator, and the charged gel-like damping material features a hollow space formed therein, whereby an increase in the inertial mass of the printing head is reduced due to the formation of the hollow space in the charged damping material. Preferably, the damping material is composed of gel-like silicone resin. Further preferably, the hollow space formed in the charged damping material is charged with a foam rubber such as polyurethane foam rubber.

Similarly, the actuator means may comprise either a piezoelectric type or electromagnetic type.

BRIEF DESCRIPTION OF THE DRAWINGS

Other objects and advantages of the present invention will be better understood from the following description, with reference to the accompanying drawings, in which.

DESCRIPTION OF THE PREFERRED EMBODIMENTS

Figure 1:
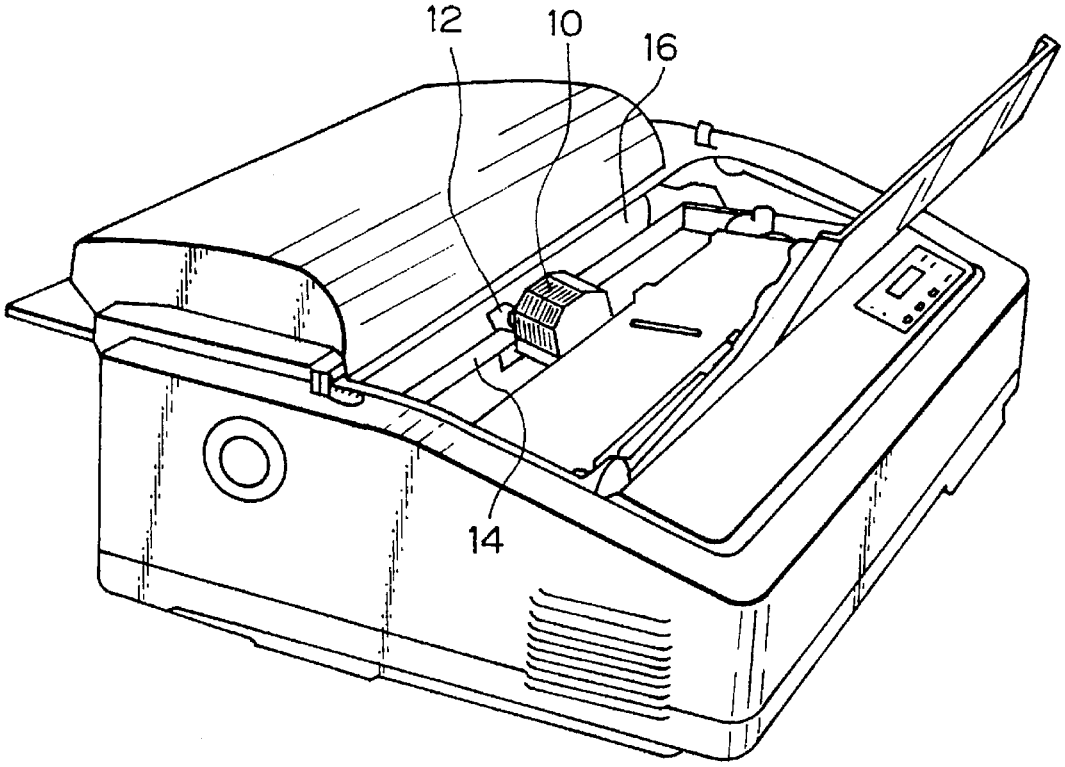
FIG. 1 is a perspective view showing a wire-dot type printer in which a printing head according to the present invention is incorporated.

FIG. 1 shows a representative type of wire-dot printer having a printing head 10 in which the present invention is embodied. The printing head 10 is attached to and supported by a carrier 12 which is slidably mounted on a guide bar 14 which extends along a platen 16. During operation of the printer, the carrier 12 with the printing head 10 is moved along the guide bar 14 by a suitable drive mechanism.

Figure 2:
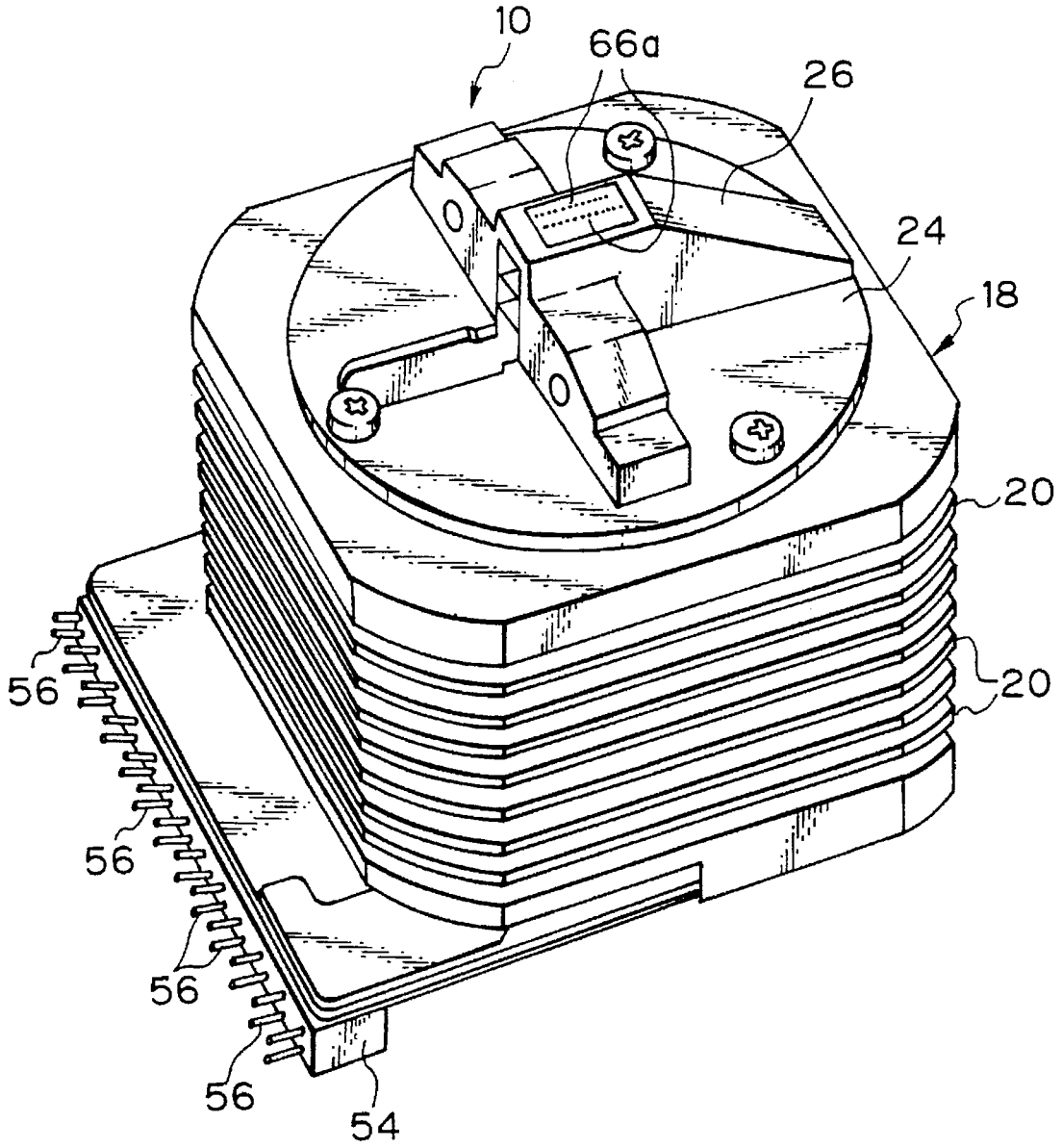
FIG. 2 is an enlarged perspective view of the printing head shown in FIG. 1.
Figure 3:
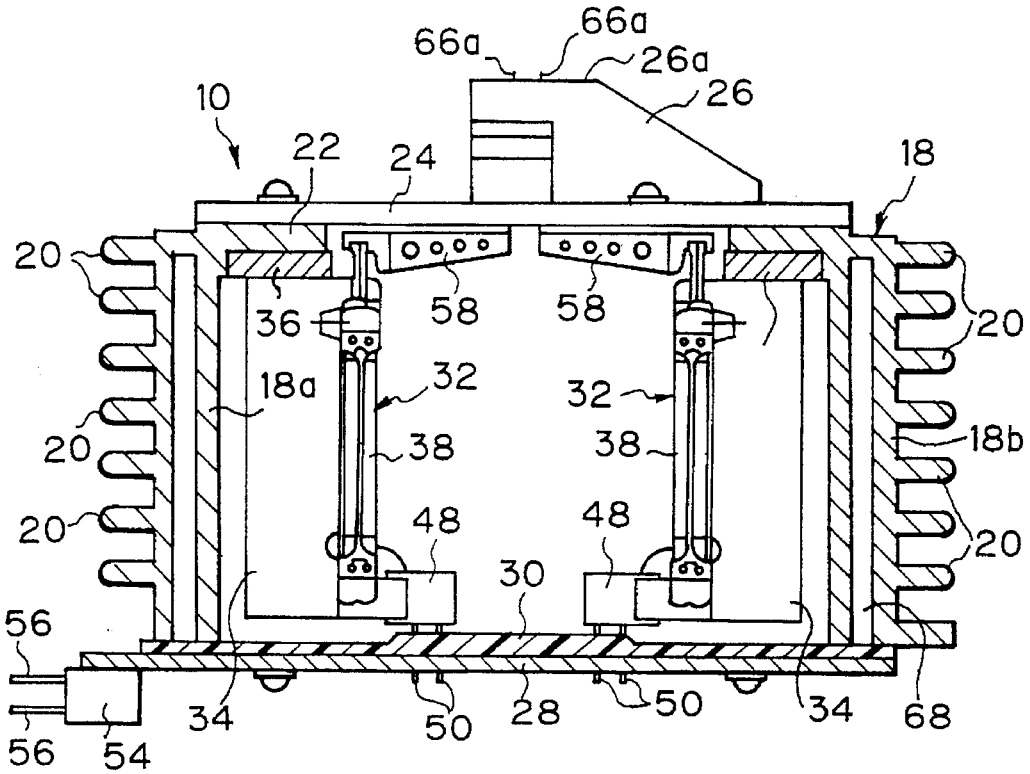
FIG. 3 is a longitudinal cross-sectional view of a wire-dot printing head constituted according to a first aspect of the present invention.

FIG. 2 shows an appearance of the printing head 10, and FIG. 3 shows an internal arrangement thereof. The printing head 10 comprises an annular housing 18 formed of a suitable metal such as steel, and the housing 18 has heatradiating fins 20 extending outwardly from an outer side wall thereof, and an inner flange 22 extending inwardly from an inner peripheral edge of a front annular end thereof. The printing head 10 also comprises a disk-like plate 24 securely attached to the inner flange 22 of the housing 18 and having a nose member 26 integrally formed thereon, and a printed circuit board 28 securely attached to the other, or rear, annular end of the housing 18 through the intermediary of a suitable rubber sheet 30.

Figure 4:
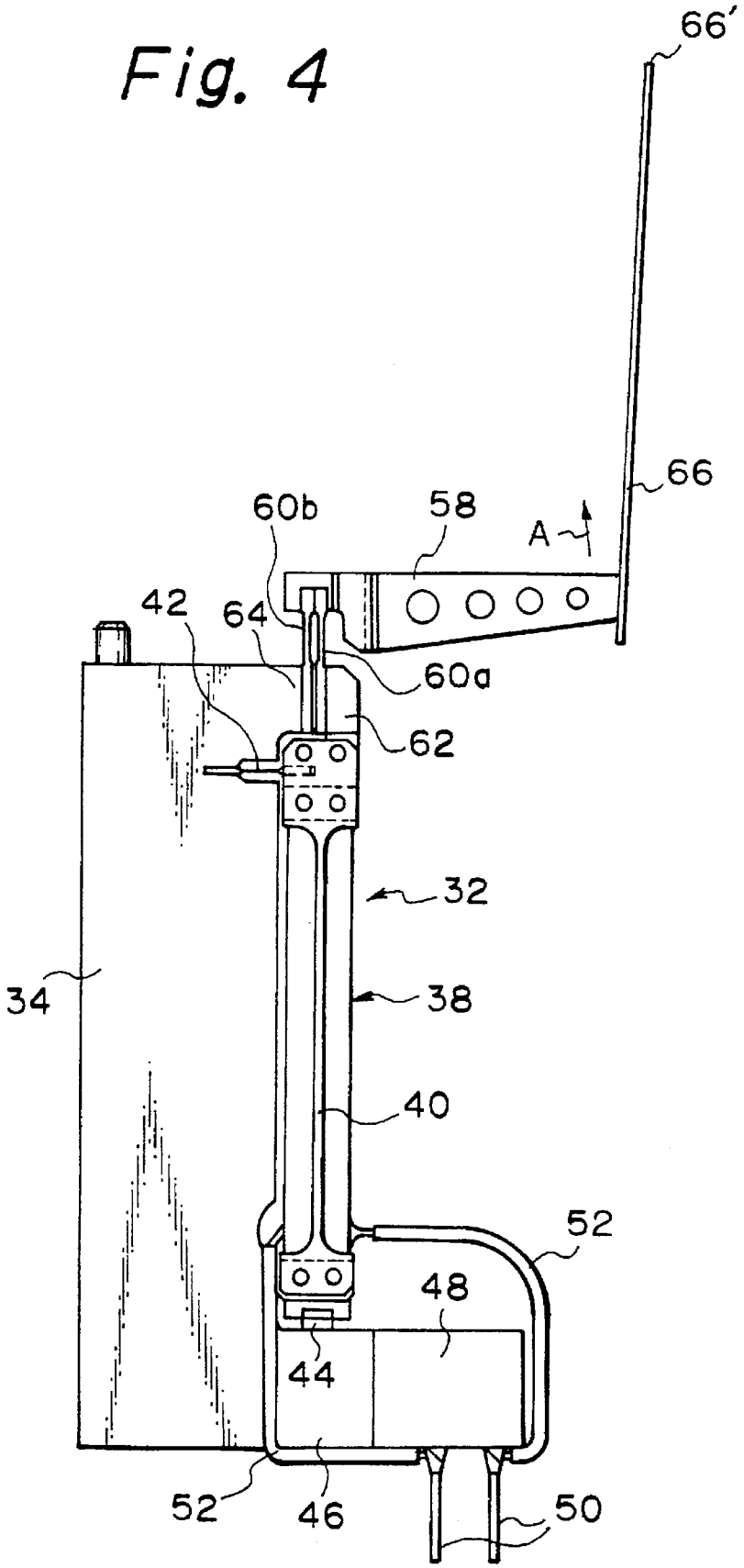
FIG. 4 is an enlarged elevation view showing a piezo-actuator assembly incorporated in the printing head shown in FIG. 3.

In this embodiment, the printing head 10 comprises twenty-four piezo-actuator assemblies 32 accommodated in the housing 18 and annularly arranged along an inner wall surface thereof at regular intervals. As shown in FIG. 4, each of the piezo-actuator assemblies 32 includes a block member 34 securely attached to the inner flange 22 of the housing through the intermediary of a ring member 36 see FIGS. 3 and 5, and a piezo stack 38 supported by the block member 34. In particular, the piezo stack 38 is composed of a plurality of piezo elements integrally held by a tie band 40, the ends of which are securely joined to the front and rear ends of the piezo stack 38, respectively. The front end of the piezo stack 38 is joined to the block member 34 through the intermediary of a tie strip 44, and the rear end thereof is joined to an end of a screw 44 threaded in a portion 46 which extends inwardly from the rear end of the 20 block member 34.

A connector 48 is attached to the extended portion 46 of the block member 34, and has a pair of connecting pins 50 which are inserted into the printed circuit board 28, as shown in FIG. 3, and which are electrically connected to plus and minus electrode terminals of the piezo stack 38 through a pair of electric leads 52. Also, a multi-connector 54 is mounted on the circuit board 28, as shown in FIGS. 2 and 3, and has a plurality of connecting pins 56 which are electrically connected to a control circuit board of the printer through a flexible flat cable (not shown). Of course, the respective connecting pins 56 of the multi-connector 54 are connected to the connecting pins of the connectors 48 of the twenty four piezo-actuator assemblies through a circuit pattern formed on the board 28, and thus the twenty four piezo stacks 38 can be selectively energized by a driver source circuit provided on the control circuit board of the printer.

Each of the piezo-actuator assemblies 32 further includes an lever arm 58 which is supported by the block member 34 and the piezo stack 38 through the intermediary of a pair of parallel leaf spring elements **60*a* and 60*b*, as best shown in FIG. 4. In particular, one end of the leaf spring element 60*a* is securely joined to an outer end of the lever arm 58, and the other end thereof is securely joined to a block piece 62 fixed to the front end of the piezo stack 38. Also, one end of the leaf spring element 60*b* is securely joined to an outer end of the arm lever 58, and the other end thereof is securely joined to a portion 64 which extends inwardly from the front end of the block member 34. The lever arm 58 has a wire element 66 securely attached to an inner or free end thereof, and the wire element 66 is extended through the disk-like plate 24 and the nose member 26 such that a free end 66*a* of the wire element 66 projects from a front face 26*a* of the nose member 26, as shown in FIG. 3. When the piezo stack 38 shown in FIG. 4 is electrically energized, the height or length thereof is increased, so that the lever arm is rotated in a direction indicated by an arrow A about a middle point of a span length of the leaf spring element 60*b*. Accordingly, although the increment of the height or length of the piezo stack 38 is very small, it is amplified by the lever arm 58 so that the wire element 66** can be driven through a sufficient stroke.

As best shown in FIG. 2, the free ends **66*a* of the twenty four wire elements 66 are arranged in two parallel columns at a given pitch, and the free ends 66*a* included in one of the two columns are shifted by one-half of said pitch with respect to the free ends 66*a*** included in the other column. Namely, the increment of one-half of the pitch represents a dot pitch at which printing is carried out by the illustrated printing head.

According to a first aspect of the present invention, the printing head 10 is characterized in that an annular hollow space 68 is formed in the annular housing 18 so that the side wall thereof is formed as a double-side wall including an inner annular wall **18*a* and an outer annular wall 18*b* spaced from each other, as shown in FIG. 3. This double side-wall arrangement contributes to dampen noise and vibration produced by the operation of the printing head 10. Furthermore, the weight of the printing head 10 is reduced due to the formation of the annular hollow space 68, and thus an inertial mass thereof becomes smaller. This contributes towards high-speed printing, because it is possible to quickly accelerate and decelerate the printing head 10. Although the formation of the annular hollow space 68 in the annular housing 18 is preferable, a single arcuate hollow space or plural arcuate hollow spaces may be formed in the annular housing 18**, if necessary.

Figure 5:
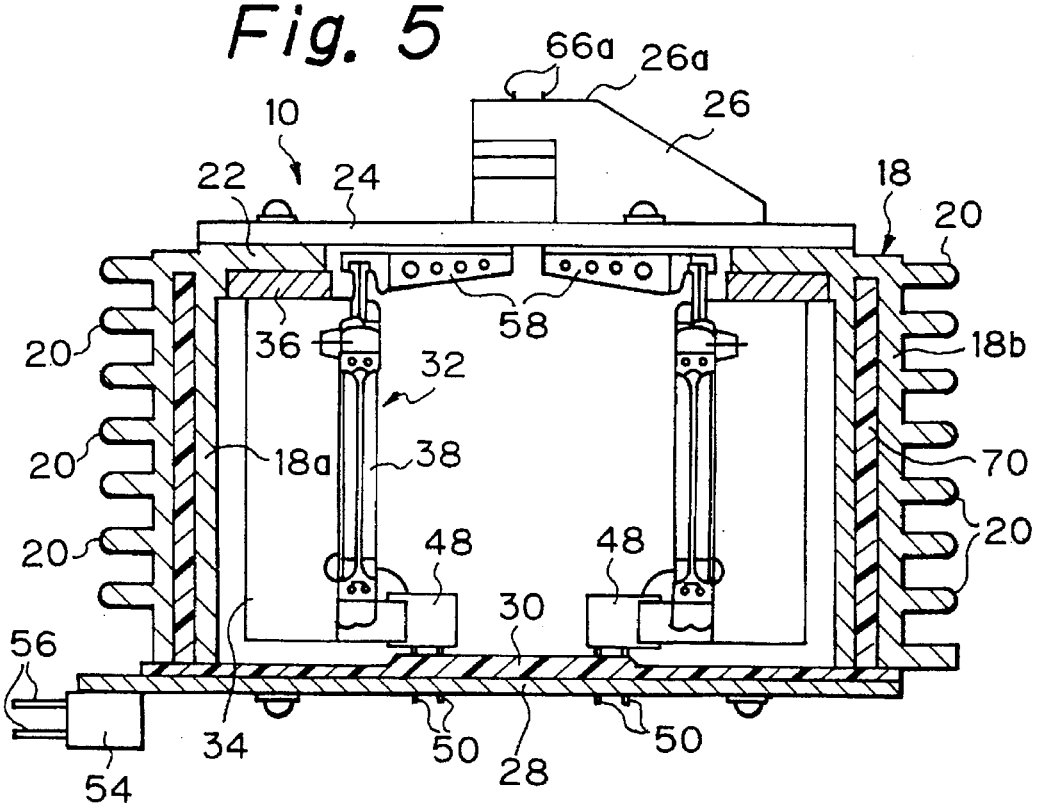
FIG. 5 is a longitudinal cross-sectional view showing a modification of the embodiment shown in FIG. 3.

FIG. 5 shows a modification of the embodiment shown in FIG. 3. In this modified embodiment, the annular hollow space formed in the annular housing 18 is charged with a suitable sound-absorbent material 70 such as foam rubber, gel-like resin or the like. For example, the foam rubber may be polyurethane foam rubber, and the gel-like resin may be gel-like silicone resin as disclosed in the above-mentioned JUPP'356.

Figure 6:
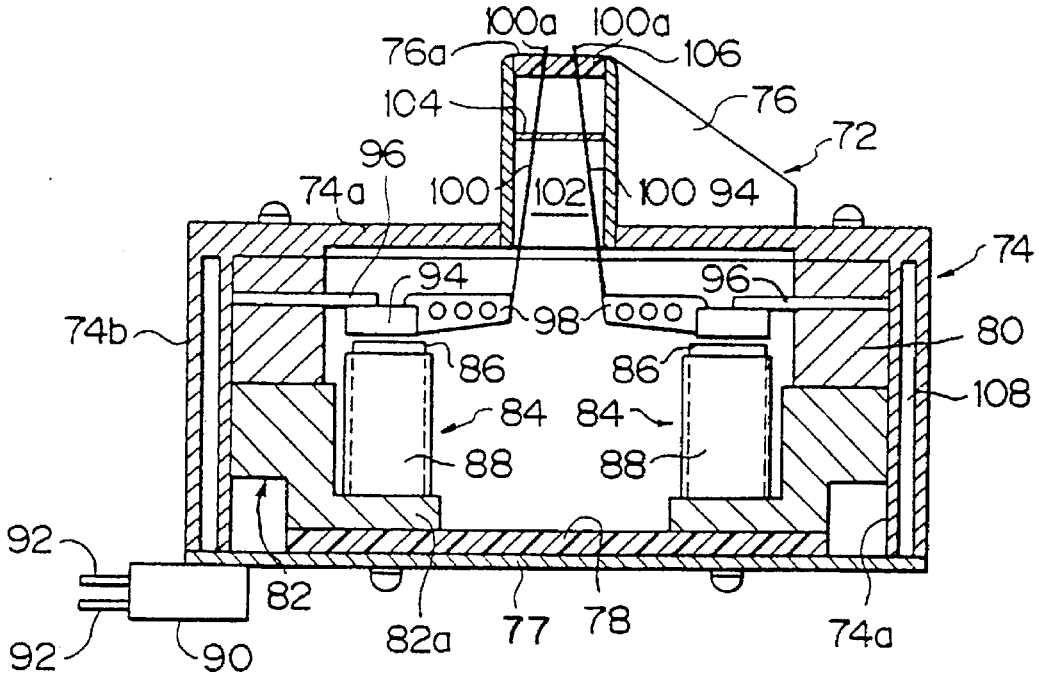
FIG. 6 is a longitudinal cross-sectional view of another type of wire-dot printing head constituted according to the first aspect of the present invention.

FIG. 6 shows another type of wire-dot printing head constituted in accordance with the first aspect of the present invention. This wire-dot printing head, which is generally indicated by reference 72, comprises an annular housing 74 formed of a suitable metal material and having a nose member 76 securely mounted on a front end wall **74*a* thereof, and a printed circuit board 77 securely attached to an rear annular end of the housing 74 through the intermediary of a suitable rubber sheet 78**.

The printing head 72 comprises a ring-like permanent magnet member 80 accommodated in the housing and securely attached to the inner face of the front end wall **74*a* thereof, an annular block member 82 made of a suitable magnetic material and securely attached to the permanent magnet 80, and twenty four electromagnetic actuator assemblies 84 which are accommodated in an inner chamber defined by the magnet member 80 and the block member 82, and which are annularly arranged along an inner wall surface thereof at regular intervals. Each of the electromagnetic actuator assemblies 84 includes a core 86 securely mounted on an inner flange portion 82*a* which extends inwardly from the annular block member 82, and a solenoid 88 surrounding the core 86 and electrically connected to a multi-connector 90 through a circuit pattern formed on the printed circuit board 77. The multi-connector 90 is mounted on the circuit board 77, and has a plurality of connecting pins 92 which are electrically connected to a control circuit board of the printer through a flexible flat cable (not shown). Thus, the twenty four solenoids 88** can be selectively energized by a driver source circuit provided on the control circuit board of the printer.

Each of the electromagnetic assemblies 84 further includes an armature 94 supported by a leaf spring 96 projected from the magnet member 80 in a cantilever manner, and a beam member 98 securely attached to the armature and extending toward a center of the housing 74. The beam member 98 has a wire element 100 securely attached to an inner or free end thereof, and the wire element 98 extends through and projects out of the nose member 76. In particular, a through bore 102 is formed in the nose member 76 for the passage of the wire elements 100, and a guide plate 104 and an end wall member 106 are provided in the through bore 102. The guide plate 104 may be formed of a suitable metal material, and has twenty four small guide holes formed therein, through which the wire elements 100 respectively pass. The end wall member 106, which may be formed of a suitable hard resin material, defines a front face **76*a* of the nose member 76, and has twenty four small holes formed therein, through which the free ends 100*a* of the wire elements project out of the front face 76*a***.

When each of the solenoids 88 is not electrically energized, the corresponding core 86 cooperates with the permanent magnet member 80 and the magnetic block member 82 to form a closed magnetic circuit, and thus the corresponding armature 94 is magnetically adhered to the free end face of the core 86 against a resilient force of the leaf spring 96. The electrical energizing of the solenoid 88 is carried out such that the closed magnetic circuit is broken, whereby the armature 88 is quickly moved from the position at which it is magnetically adhered to the free end face of the core 86, due to the resilient force of the leaf spring. Thus, the corresponding wire element 100 is driven so as to make a dot.

Similarly to the embodiment as shown in FIG. 3, the printing head 72 is characterized in that an annular hollow space 108 is formed in the annular housing 74 so that the side wall thereof is formed as a double-side wall including an inner annular wall **74*a* and an outer annular wall 74*b* spaced from each other, as shown in FIG. 6. Of course, this double side-wall arrangement also contributes to damp noise and vibration produced by operation of the printing head 72, and an inertial mass of the printing head 72 also becomes smaller due to the formation of the annular hollow space 108. Similarly to the embodiment of FIG. 3, in place of the formation of the annular hollow space 108, a single arcuate hollow space or plural arcuate hollow spaces may be formed in the annular housing 18**, if necessary.

Figure 7:
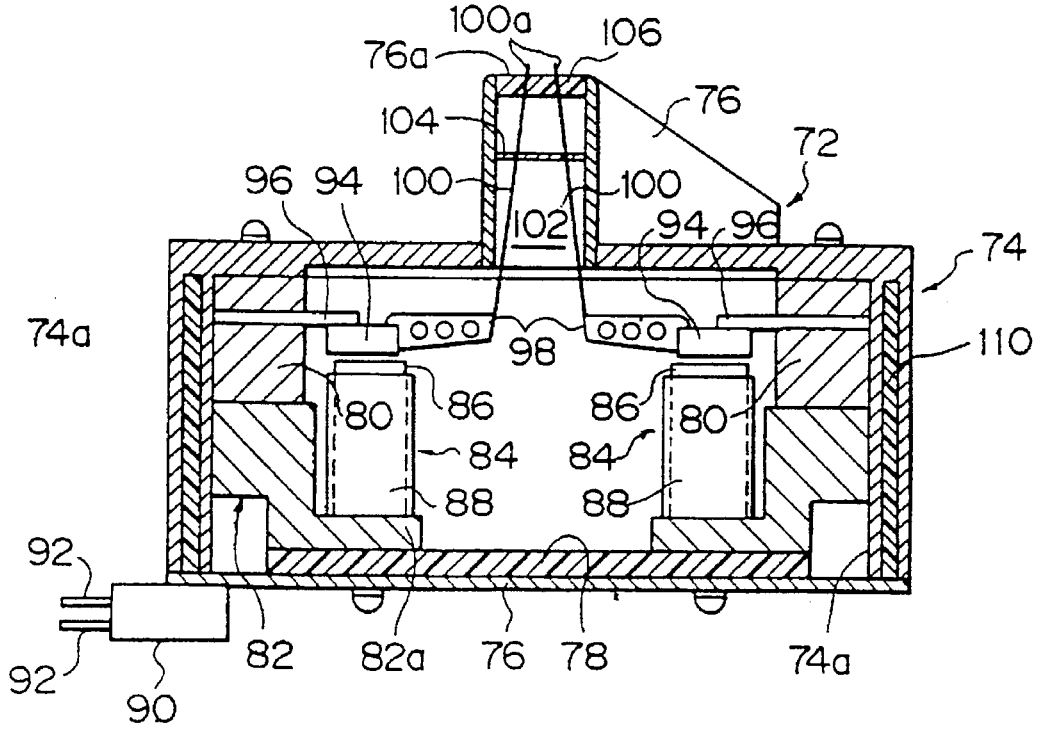
FIG. 7 is a longitudinal cross-sectional view showing a modification of the embodiment shown in FIG. 6.

FIG. 7 shows a modification of the embodiment of shown in FIG. 6. In this modified embodiment, the annular hollow space formed in the annular housing 74 is charged with a suitable sound-absorbent material 110 such as foam rubber, gel-like resin or the like. Similarly to the embodiment as shown in FIG. 5, the foam rubber may be a polyurethane foam rubber, and the gel-like resin may be a gel-like silicone resin as disclosed in the above-mentioned JUPP' 356.

Figure 8:
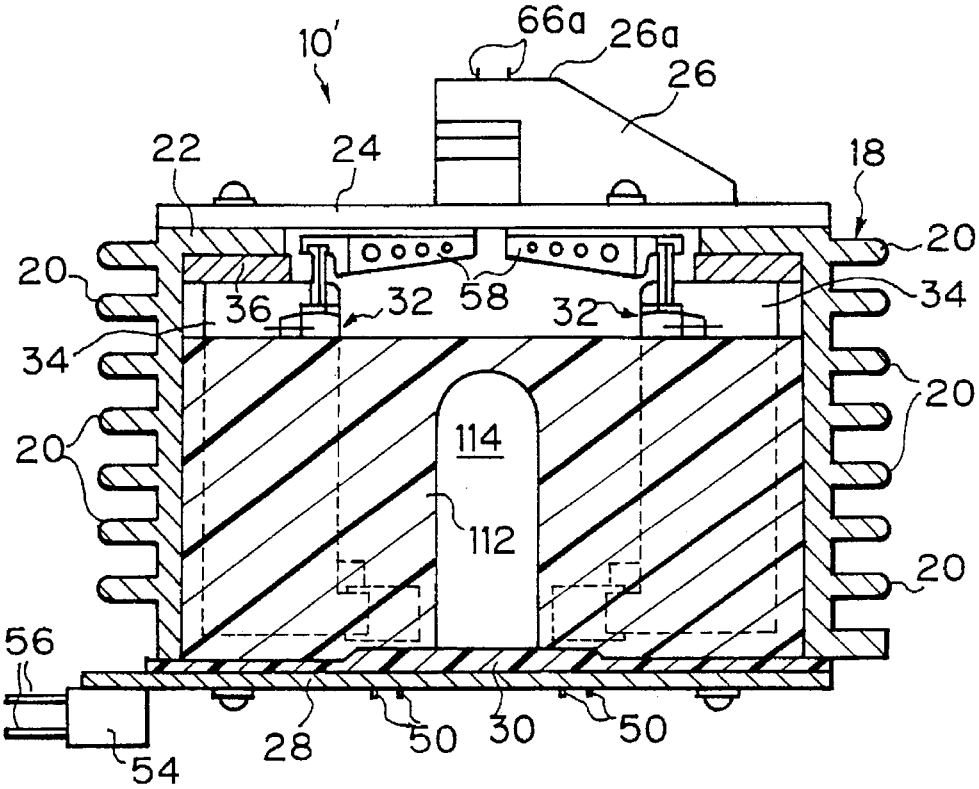
FIG. 8 is a longitudinal cross-sectional view of a wire-dot printing head constituted according to a second aspect of the present invention.

FIG. 8 shows a wire-dot printing head constituted in accordance with a second aspect of the present invention. This printing head, which is generally indicated by reference 10', is arranged in substantially the same manner as the printing head 10 shown in FIG. 3. Note, in FIG. 8, the same references as in FIG. 3 represent the same elements. In this embodiment, the annular housing 18 has no annular hollow space formed in the side wall thereof, but an interior of the housing 18 is partially charged with gel-like noise/vibration damping material 112 so that the movable elements are not embedded in the charged damping material. Preferably, the damping material 112 is composed of gel-like silicone resin as disclosed in the JUPP'356. According to the second aspect of the present invention, a hollow space 114 is formed in the charged damping material 112, and thus an increase in the inertial mass of the printing head 10' can be reduced due to the formation of the hollow space 114. Further, the existence of the hollow space 114 in the damping material 112 contributes toward damping the noise and the vibration produced by the operation of the printing head 10'.

Figure 9:
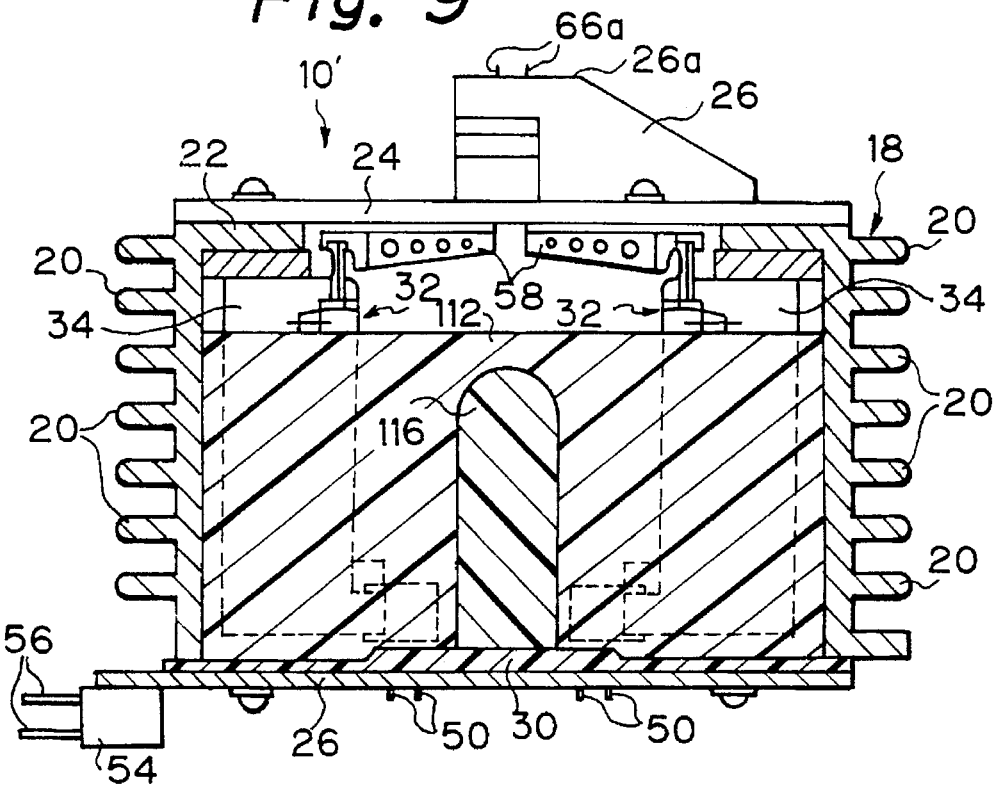
FIG. 9 is a longitudinal cross-sectional view showing a modification of the embodiment shown in FIG. 8.

FIG. 9 shows a modification of the embodiment as shown in FIG. 8. In this modified embodiment, the hollow space formed in the damping material 112 is charged with foam rubber 116 which is generally very light, and which may be polyurethane foam rubber. The charging of the foam rubber can further contribute toward damping the noise and the vibration produced by the operation of the printing head 10'.

Figure 10:
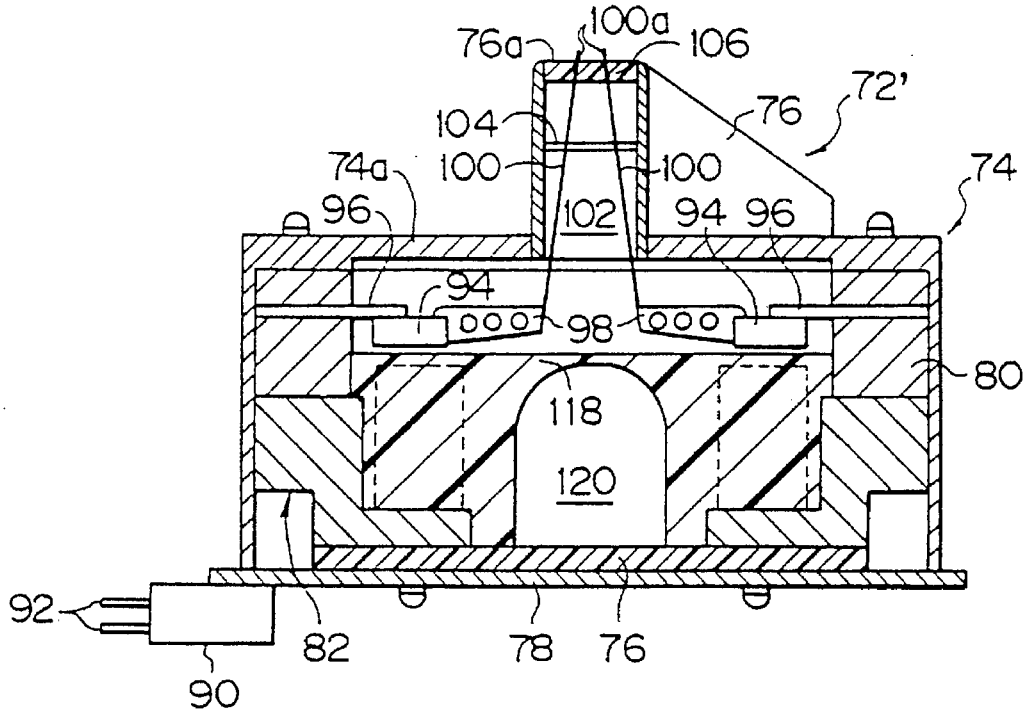
FIG. 10 is a longitudinal cross-sectional view of another type of wire-dot printing head constituted according to the second aspect of the present invention.

FIG. 10 shows another type of wire-dot printing head constituted in accordance with the second aspect of the present invention. This printing head, which is generally indicated by reference 72', is arranged in substantially the same manner as the printing head 72 shown in FIG. 6. Note, in FIG. 10, the same reference numerals as in FIG. 6 represent the same elements. Similar to the embodiment shown in FIG. 8, the annular housing 74 has no annular hollow space formed in the side wall thereof, but an interior of the housing 74 is partially charged with noise/vibration damping material 118 so that the movable elements are not embedded in the charged damping material. Similarly, the damping material 118 is preferably composed of gel-like silicone resin as disclosed in the JUPP'356. The charged damping material 118 also features a hollow space 120 formed therein, and thus an increase in the inertial mass of the printing head 72' can be reduced due to the formation of the hollow space 120. 0f course, the existence of the hollow space 120 in the damping material 118 contributes toward damping the noise and the vibration produced by the operation of the printing head 72'.

Figure 11:
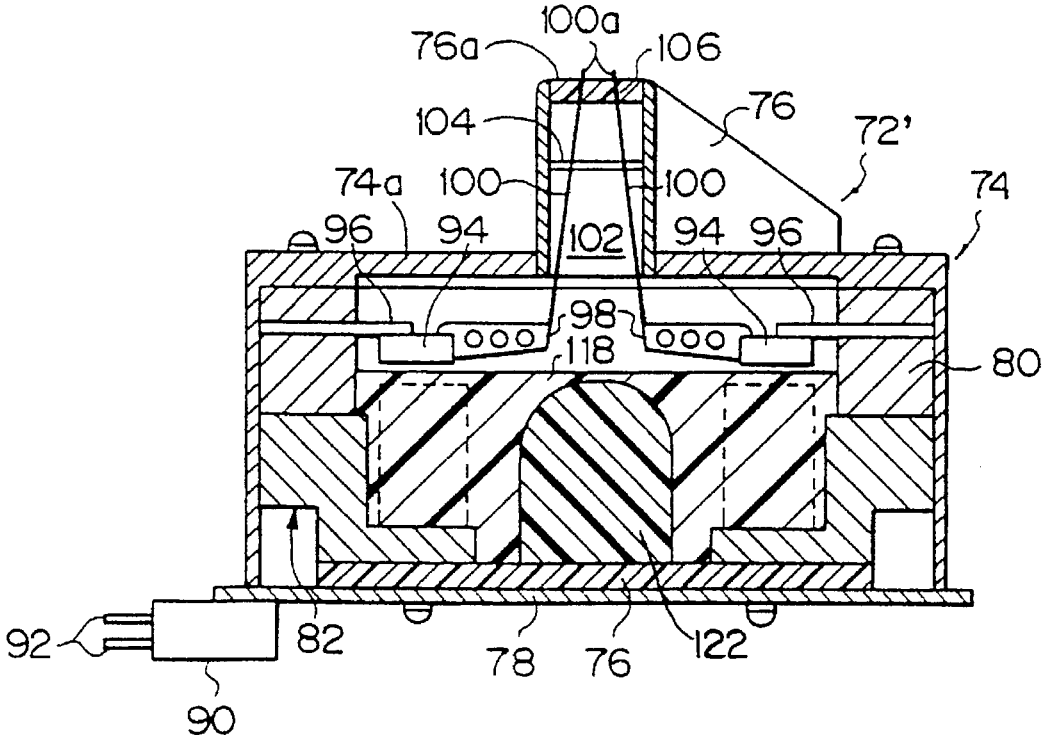
FIG. 11 is a longitudinal cross-sectional view showing a modification of the embodiment shown in FIG. 10.

FIG. 11 shows a modification of the embodiment as shown in FIG. 10. In this modified embodiment, the hollow space formed in the damping material 118 is charged with foam rubber 122 which is generally very light, and which may be polyurethane foam rubber. Similar to the embodiment shown in FIG. 9, the charging of the foam rubber can further contribute toward damping the noise and the vibration produced by the operation of the printing head 72'.

In the embodiments shown in FIGS. 8 and 10, a plurality of hollow spaces may be formed in the charged damping material 112, 118. Of course, these hollow spaces may be also charged with the foam rubber.

Finally, it will be understood by those skilled in the art that the foregoing description is of preferred embodiments of the present invention, and that various changes and modifications can be made without departing from the spirit and scope thereof.

We claim:

1. A wire-dot printing head, comprising:

a housing having an interior, a first end and a second end;

an actuator accommodated in the interior of said housing;

a plurality of wire elements, extending into the interior of said housing, engaged and driven by said actuator;

said housing comprising an inner peripheral side wall portion surrounding the interior of the housing and the actuator, an outer peripheral side wall portion surrounding the inner side wall portion and defining a hollow space therebetween and a first end wall at the first end of the housing, extending between the inner and outer peripheral sidewalls and closing the hollow space therebetween at the first end of the housing, the actuator being supported by the first end wall;

a non-liquid phase type sound-absorbent material charged in the hollow space between the inner and outer peripheral side wall portions for damping noise and vibration produced during operation of said actuator means; and the interior of the housing and the hollow space being accessible at the second end of the housing for inserting therein, respectively, the actuator and the charge of non-liquid phase type sound-absorbent material.

2. A wire-dot printing head as set forth in claim 1, wherein said non-liquid phase type sound-absorbent material comprises foam rubber.

3. A wire-dot printing head as set forth in claim 1, wherein said non-liquid phase type sound-absorbent material comprises a gel-like resin.

4. A wire-dot printing head as set forth in claim 3, wherein said gel-like resin is a gel-like silicone resin.

5. A wire-dot printing head as set forth in claim 1, wherein said hollow space comprises an annular hollow space.

6. A wire-dot printing head as set forth in claim 1, wherein said actuator comprises a piezoelectric type actuator.

7. A wire-dot printing head as set forth in claim 1, wherein said actuator comprises an electromagnetic type actuator.

8. A wire-dot printing head as set forth in claim 1, wherein the hollow space is at least partially filled with a gas.

9. A wire-dot printing head as set forth in claim 1, wherein the interior of the housing defining, at the second end of the housing, an opening of sufficient extent to receive the actuator within the housing interior and the hollow space being common accessible for receiving and accommodating therein the charge of non-liquid face sound-absorbent material and commonly disposed therewith for closure by common, second end wall.

10. A wire-dot printing head comprising:

a housing;

an actuator accommodated in said housing;

a plurality of wire elements, extending into said housing, engaged and driven by said actuator;

an interior of said housing being partially charged with a non-liquid phase type damping material for damping noise and vibration produced during operation of said actuator, and said charge of non-liquid phase type damping material having a hollow space therein, thereby to minimize an increase in an inertial mass of the printing head due to the charge of damping material.

11. A wire-dot printing head as set forth in claim 10, wherein said damping material comprises gel-like silicone resin.

12. A wire-dot printing head as set forth in claim 10, wherein said actuator comprises a piezoelectric type actuator.

13. A wire-dot printing head as set forth in claim 10, wherein said actuator comprises an electromagnetic type actuator.

14. A wire-dot printing head as set forth in claim 10, wherein said hollow space is charged with foam rubber.

15. A wire-dot printing head as set forth in claim 14, wherein said foam rubber comprises polyurethane foam rubber.

16. A wire-dot printing head as set forth in claim 14, wherein said actuator comprises a piezoelectric type actuator.

17. A wire-dot printing head as set forth in claim 14, wherein said actuator comprises an electromagnetic type actuator.

18. A wire-dot printing head as set forth in claim 10, wherein the hollow space is at least partially filled with a gas.

19. A wire-dot printing head comprising:

a housing having an interior and first and second ends;

an actuator accommodated in the interior of said housing;

a plurality of wire elements, extending into the interior of said housing, engaged and driven by said actuator;

said housing comprising a peripheral sidewall defining first and second openings at the respective first and second ends of the housing and a first end wall at the first end of the housing extending inwardly therefrom and defining a corresponding opening of reduced size relative to the first opening and through which at least end portions of the plurality of wire elements are disposed, the actuator being supported by the first end wall; and an interior of said housing being partially charged with a non-liquid phase type damping material for damping noise and vibration produced during operation of said actuator, and said charge of non-liquid phase type damping material having a hollow space therein, thereby to minimize an increase in an inertial mass of the printing head due to the charge of damping material, the hollow space being centrally disposed within the housing interior at the second end of the housing and extending from the second end and toward the first end.

20. A wire-dot printing head as recited in claim 19, wherein the interior of said housing is partially charged so as to provide a surface of the non-liquid phase type damping material within the interior of the housing and displaced from the first end of the housing and substantially parallel thereto.

21. A wire-dot printing head as recited in claim 20, wherein the hollow space within the non-liquid phase type damping material extends from the second end of the housing and toward, but displaced from, the surface of the non-liquid phase type damping material within the interior of the housing.

22. A wire-dot printing head as recited in claim 20, wherein the interior of the housing defines a central opening and the hollow space defines a surrounding opening, surrounding the central opening, and the central and surrounding openings are commonly disposed for closure by a common, second end wall.

* * * * *